United States Patent [19]

Iepson et al.

[11] 4,130,200

[45] Dec. 19, 1978

[54] DISPLAY PACKAGE FOR BATTERIES OR THE LIKE

[75] Inventors: Harry E. Iepson, Lino Lakes, Minn.; Richard A. Erickson, New Richmond, Wis.

[73] Assignee: Gould Inc., Rolling Meadows, Ill.

[21] Appl. No.: 794,630

[22] Filed: May 6, 1977

[51] Int. Cl.[2] ..... B65D 85/20; B65D 85/62; B65D 7/12

[52] U.S. Cl. ..... 206/333; 206/427; 206/446; 220/4 E; 220/23.83

[58] Field of Search ..... 206/333, 446, 162, 145, 206/427, 806; 220/23.83, 23.8, 4 E, 4 B, 94 A

[56] References Cited

U.S. PATENT DOCUMENTS

| | | | |
|---|---|---|---|
| 2,042,799 | 6/1936 | Ort | 206/806 |
| 2,695,723 | 11/1954 | Waterman | 220/4 E |
| 2,928,541 | 3/1960 | Fielding | 206/427 |
| 3,482,756 | 12/1969 | Collie | 206/427 |
| 3,693,830 | 9/1972 | Oglesbee | 206/162 |

*Primary Examiner*—William T. Dixson, Jr.

*Attorney, Agent, or Firm*—Leydig, Voit, Osann, Mayer & Holt, Ltd.

[57] ABSTRACT

Two batteries, such as, for example, dry cells, are held in a plastic display package comprising upper and lower identical units each adapted to be molded by a single set of dies and adapted to be releasably assembled to one another with the batteries disposed between and captivated by the units.

4 Claims, 4 Drawing Figures

DISPLAY PACKAGE FOR BATTERIES OR THE LIKE

BACKGROUND OF THE INVENTION

This invention relates to a package for holding one or more articles such as dry cell batteries for point of sale display. Packages which are specifically designed to hold dry cell batteries are disclosed in Kaye U.S. Pat. No. 3,712,695 and Walus et al. U.S. Pat. No. 3,881,601. Other packages which are somewhat related to the package of the present invention are disclosed in Wherry U.S. Pat. No. 3,203,581 and Oglesbee U.S. Pat. No. 3,913,778.

SUMMARY OF THE INVENTION

The general aim of the present invention is to provide an attractive and comparatively inexpensive multi-part plastic display package having components which may be molded by identical dies and which may be quickly and easily assembled with one another and with the article or articles to be packaged.

A more detailed object of the invention is to achieve the foregoing by providing a plastic display package having a molded base unit for holding an article and having an identically molded top unit adapted to be inverted relative to and assembled releasably with the base unit to captivate the article in the base unit.

An important object of the invention is to provide a package of the foregoing type for displaying a pair of dry cell batteries in relatively compact side-by-side relation, the package being capable of being easily opened and being re-usable in the event the purchaser subsequently wishes to store the batteries.

These and other objects and advantages of the invention will become more apparent from the following detailed description when taken in conjunction with the accompanying drawings.

Figure 1:
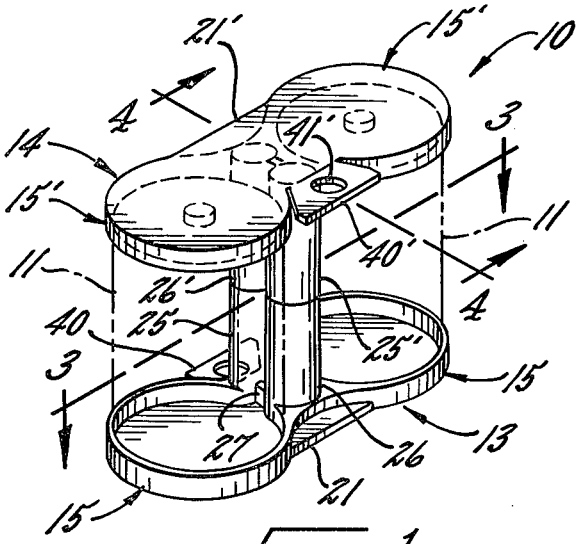
FIG. 1 is a perspective view of a new and improved display package incorporating the unique features of the present invention, the batteries being shown in phantom.

While the package of the present invention has been shown and will be described in some detail with reference to a particular embodiment, there is no intention that the invention be limited to such detail. On the contrary, it is intended here to cover all modifications, alternatives and equivalents which fall within the spirit and scope of the invention as defined by the appended claims. Thus, while the present invention will be principally described in connection with dry cell batteries having the conventional cylindrical cell configuration, it should be appreciated that this invention is equally applicable to use with any other type of battery and with other case designs.

DETAILED DESCRIPTION OF THE PREFERRED EMBODIMENT

As shown in the drawings for purposes of illustration, the invention is embodied in a package 10 for holding and displaying upright articles 11 having upper and lower end portions of substantially identical horizontal cross-sectional size and shape. While the package could be adapted to hold and display either one or several articles of this general type, it is particularly suitable for use in holding and displaying two dry cell batteries such as D-size flashlight batteries.

According to the present invention, the display package 10 comprises a unique plastic base unit 13 for holding the lower ends of the batteries 11 and further comprises an identical plastic top unit 14 which may be molded by the same dies as the base unit and which may be placed over the upper ends of the batteries and assembled to the base unit to securely captivate the batteries in side-by-side relation. Because only a single set of dies is required for molding both the base unit and the top unit, the tooling cost for the package is relatively low and thus the package may be manufactured very economically.

In the present instance, both the base unit 13 and the top unit 14 are of one-piece construction and are molded from re-ground, high density polypropylene although other suitable plastic materials could be used. The base unit and the top unit are precisely identical in a structural sense but are differently oriented in the completed package 10 in that the top unit is inverted with respect to the base unit. Accordingly, only the base unit will be described in detail with the understanding that the same description applies to the top unit except for the difference in the orientation of the two units. The parts of the top unit which correspond to the parts of the base unit have been designated by the same but primed reference numerals.

Figure 2:
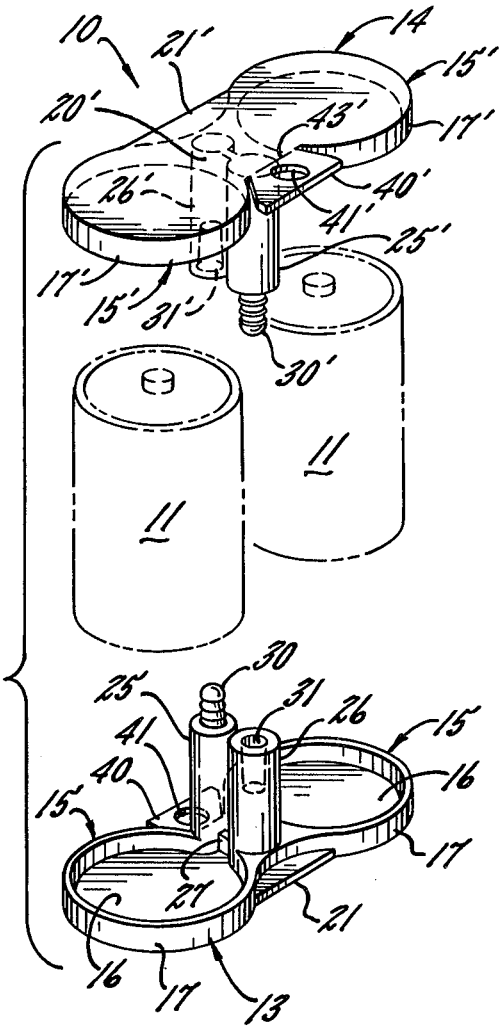
FIG. 2 is an exploded perspective view of the package and batteries shown in FIG. 1.
Figure 3:
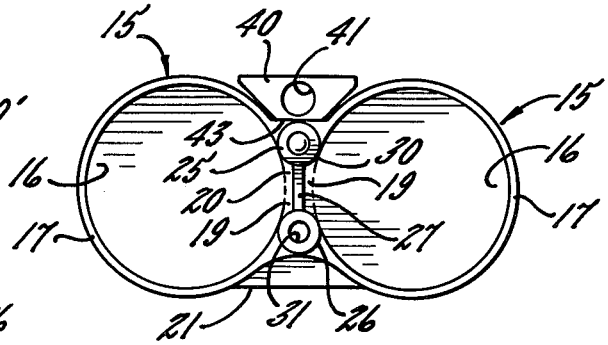
FIG. 3 is a cross-section taken substantially along the line 3—3 of FIG. 1.

As shown in FIG. 2, the base unit 13 comprises a pair of upwardly opening cup-shaped receptacles 15 each having a bottom wall 16 and an upstanding annular side wall 17. The side walls of the two receptacles are spaced horizontally from one another and are of such diameter as to telescopically receive the lower ends of the batteries 11 with a snug fit. Rather than defining a continuous ring, each side wall is interrupted by a short arcuate gap 19 in the area where the side wall most nearly approaches the other side wall. A web 20 (FIG. 3) which is coplanar with the bottom walls 16 of the receptacles spans the gaps 19 between the two side walls 17 and serves to interconnect the two receptacles. Another coplanar web 21 extends between the outer peripheries of the side walls adjacent one side of the base unit 13 and helps to keep the base unit in a stable upright position.

Figure 4:
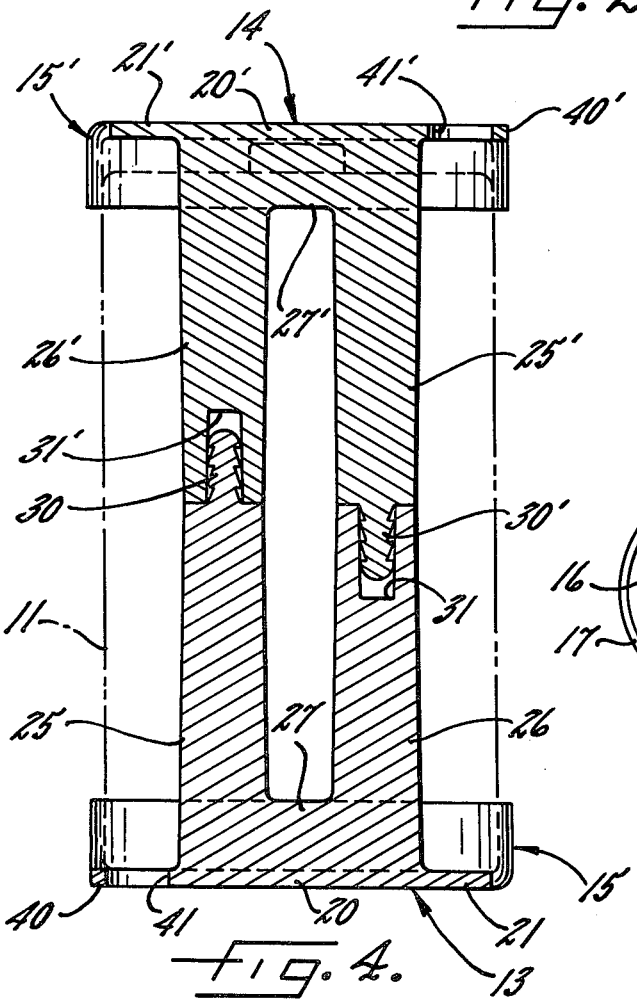
FIG. 4 is an enlarged cross-section taken substantially along the line 4—4 of FIG. 1.

In carrying out the invention, post means extend upwardly from a location between the receptacles 15 of the base unit 13 and are adapted to interfit releasably with identical post means of the top unit 14 to hold the two units and the batteries 11 in assembled relation. While the post means could be defined by a single post, it is preferred to provide two horizontally spaced posts 25 and 26 located at the ends of the gaps 19 in the side walls 17 of the receptacles 15 and disposed substantially tangent to the inner peripheries of such walls. The two posts are substantially cylindrical and are connected at their lower ends by an upstanding reinforcing rib 27 (FIGS. 3 and 4) which projects upwardly from the web 20.

The posts 25 and 26 of the base unit 13 are formed with male and female connectors 30 and 31, respectively, which are adapted to interfit securely but releasably with female and male connectors 31' and 30' on the posts 26' and 25' of the top unit 14 in order to removably join the two units. Herein, the male connector 30 is formed by a serrated stud which projects upwardly from the upper end of the post 25, the stud having a substantially hemispherical upper end. The female connector 31 is defined by a downwardly tapered hole or socket formed in the post 26 and opening out of the upper end thereof. The relaxed diameter of the socket 31 is slightly less than the diameter of the upper end of the stud 30 and thus, when the two units 13 and 14 are assembled, the studs 30 and 30' may telescope snugly but releasably into the sockets 31' and 31.

In order to package the batteries 11, one battery is placed in each of the receptacles 15 of the base unit 13. The top unit 14 then is inverted with respect to the base unit and is located above the base unit in such a position that the stud 30' and socket 31' of the top unit are aligned vertically with the socket 31 and the stud 30, respectively, of the base unit. Thereafter, the top unit 14 is shifted downwardly to cause the receptacles 15' to telescope over the upper end portions of the batteries. At the same time, the studs 30 and 30' telescope into the sockets 31' and 31, respectively, and are gripped resiliently by the walls of the sockets so as to hold the top unit, the base unit and the batteries in assembled relation. In the assembled position of the top and base units, the posts 25 and 26 and the posts 25' and 26' extend alongside the batteries throughout virtually the entire height of the batteries. Since the posts are located at the ends of the gaps 19 and are tangent to the inner peripheries of the side walls 17 and 17' of the receptacles 15 and 15', the posts define cradles which laterally support adjacent sides of the batteries.

While the studs 30 and 30' telescope into the sockets 31' and 31 sufficiently tight to keep the units 13 and 14 assembled during shipment and sale of the batteries 11, the units can be pulled apart in a relatively easy manner to enable the purchaser to remove the batteries from the receptacle 15 and 15'. Also, the units can be re-assembled and re-used if the purchaser wishes to store the batteries after having opened the package 10.

Advantageously, tabs 40 and 40' having openings 41 and 41' therethrough are molded integrally with the units 13 and 14, respectively, and may be used to hang the package from a display hook or the like. As originally molded, each tab is disposed in the same horizontal plane as the web 20, 20' of its respective unit and is located on the side of the web opposite of the web 21, 21'. Each tab 40, 40' is joined to its web 20, 20' by a thinned section of plastic defining a live hinge 43, 43' which enables the tab to be swung to a vertical position and hung from a hook. Thus, the package may form part of a hanging display as an alternative to simply resting on a shelf or in a bin.

From the foregoing, it will be apparent that the present invention brings to the art a new and improved package 10 which enables batteries 11 to be attractively displayed and which is of relatively low cost as a result of both units 13 and 14 being identical and being capable of being molded from the same dies. Indeed, the present package can provide substantial savings in transportation costs in comparison with other types of packaging. Thus, for example, in comparison to the shipping costs associated with dry cells packaged in blister cards, the improved package of this invention can provide a cost savings of about 25 percent. In addition, the units 13 and 14 lend themselves to handling by automatic assembly equipment and enable the batteries to be packaged in a comparatively fast operation.

We claim as our invention:

1. A package for holding and displaying a pair of substantially cylindrical batteries, said package comprising a base unit and an indentically formed top unit each molded of plastic, each of said units comprising a pair of cup-shaped receptacles molded integrally with and spaced horizontally from one another, the receptacles of each unit opening in a vertical direction and having substantially the same cross-sectional size and shape as said batteries, vertically extending post means molded integrally with and located between the receptacles of each unit, a socket opening vertically out of the free end of the post means of each unit, and a stud projecting vertically from the free end of the post means of each unit and sized to telescope securely but releasably into the socket in the post means of the other unit whereby batteries placed in the receptacles of said base unit may be held therein by inverting said top unit with respect to said base unit and by shifting said top unit downwardly toward said base unit to cause the receptacles of said top unit to telescope over said batteries and to cause the stud of each unit to telescope into the socket of the other unit and thereby hold said units in assembled but releasable relationship so that the package is capable of being easily opened and is reusable.

2. A package as defined in claim 1 in which the post means of each unit is defined by two separate posts, the posts of each unit being spaced horizontally from one another and being disposed substantially tangent to the receptacles of the unit.

3. A package as defined in claim 1 in which each of said receptacles includes a vertically projecting annular wall, there being a gap in the wall of each receptacle of each unit in an area where the wall approaches the wall of the other receptacle of the unit, the post means of each unit being defined by two substantially cylindrical posts spaced horizontally from one another and located at the ends of the gaps of the unit and substantially tangent to the inner peripheries of the walls of the unit.

4. A package as defined in claim 1 further including a tab molded integrally with and projecting horizontally from each unit adjacent the receptacles thereof, an opening formed through each tab, and a hinge connecting each tab to its respective unit and permitting said tab to be swung to an upright position.

* * * * *